US007671759B2

(12) United States Patent
Kuroda

(10) Patent No.: US 7,671,759 B2
(45) Date of Patent: Mar. 2, 2010

(54) REMOTE CONTROL UNIT

(75) Inventor: Shinji Kuroda, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 1096 days.

(21) Appl. No.: 11/247,334

(22) Filed: Oct. 11, 2005

(65) Prior Publication Data

US 2006/0087446 A1 Apr. 27, 2006

(30) Foreign Application Priority Data

Oct. 12, 2004 (JP) ..... 2004-297769

(51) Int. Cl.
*G08C 19/00* (2006.01)

(52) U.S. Cl. ..... 340/825.69; 368/10; 708/111; 708/112

(58) Field of Classification Search ..... 340/825.69; 368/10; 708/111, 112
See application file for complete search history.

(56) References Cited

U.S. PATENT DOCUMENTS 4,825,200 A * 4/1989 Evans et al. ..... 341/23
4,918,439 A * 4/1990 Wozniak et al. ..... 340/825.69
5,291,193 A * 3/1994 Isobe et al. ..... 340/825.69
5,412,377 A * 5/1995 Evans et al. ..... 340/825.22
5,909,061 A * 6/1999 Sasaki et al. ..... 307/44
5,953,144 A * 9/1999 Darbee et al. ..... 398/112
6,774,790 B1 * 8/2004 Houston ..... 340/556
7,010,805 B2 * 3/2006 Hayes et al. ..... 725/153
7,142,127 B2 * 11/2006 Hayes et al. ..... 340/825.22
7,268,694 B2 * 9/2007 Hayes et al. ..... 340/825.22
2005/0110880 A1 * 5/2005 Parulski et al. ..... 348/231.5
2006/0087446 A1 * 4/2006 Kuroda ..... 340/825.72
2006/0111183 A1 * 5/2006 MacIver ..... 463/36
2008/0059880 A1 * 3/2008 Cato et al. ..... 715/700

FOREIGN PATENT DOCUMENTS

JP 07-260963 10/1995

* cited by examiner

*Primary Examiner*—Daniel Wu
*Assistant Examiner*—Bradley E Thompson
(74) *Attorney, Agent, or Firm*—Rankin, Hill & Clark LLP

(57) ABSTRACT

There is provided a remote control unit capable of setting time by a simple operation at a time when a battery is attached. In the remote control unit which is operated by the battery to remote-control operation start and stop of an apparatus main body and in which setting of a timer operation by a clocking means is possible, when the battery is attached to start the operation, a forced mode setting means displays a clocking initial value in a liquid crystal display in step 1, starts a monitor timer in step 2, and sets a "time setting mode" in which the setting of a clocking start initial value is possible by UP and DOWN switches without depending on the operation of a time set switch. When the UP or DOWN switch is not operated in step 3, and time is up in the monitor timer in step 6, processing advances to step 7, and the forced mode setting means switches the mode from the "time setting mode" to an "operation instructing mode" in which the operation of the apparatus main body is possible by an ON/OFF switch.

4 Claims, 6 Drawing Sheets

REMOTE CONTROL UNIT

BACKGROUND OF THE INVENTION

1. Field of the Invention

The present invention relates to a remote control unit, more specifically, the present invention relates to a battery operated remote control unit that includes a clock function and a timer function.

2. Description of the Related Art

A remote control unit for controlling a main body apparatus that includes a timer function to transmit a signal to the main body apparatus at a preset time is known (see, e.g., Japanese Patent Application Laid-Open No. 7-260963).

The remote control unit must also include a clock function in order to utilize the timer function. The user, however, needs to perform an operation in order to set a clocking initial value of a clock to the present time when a battery is initially attached to the remote control unit or when the battery of the remote control unit is replaced. In the remote control unit in Patent Document 1 described above, a laborious operation has to be disadvantageously performed to operate up and down switches to set the clocking initial value after the battery is attached to the remote control unit. Further, a clock switch is operated to bring the unit into a state in which the setting of the clocking initial value is possible.

Therefore, an object of the present invention is to solve the above-described disadvantage and provide a remote control unit in which time setting is possible by a simple operation at a time of attaching of the battery.

SUMMARY OF THE INVENTION

The present invention has been developed to achieve the above-described object, and relates to an improvement of a remote control unit which is operated by a battery to remote-control operation start and operation stop of an apparatus main body, the unit comprising: communication means for communicating with the apparatus main body; operation instructing means for instructing the operation start and the operation stop of the apparatus main body according to operation by user; clocking means; time setting means for setting a clocking initial value of the clocking means according to operation by the user; mode switching means for switching according to operation by the user an operation instructing mode in which the instruction by the operation instructing means is possible and the setting of the clocking initial value by the time setting means is impossible and a time setting mode in which the operation instruction by the operation instructing means is impossible and the setting of the clocking initial value by the time setting means is possible; operation control means for transmitting a control signal to instruct actuation or de-actuation with respect to the apparatus main body, when the operation instructing means is operated; and timer control means for setting timer operation to perform the actuation or the de-actuation of the apparatus main body, when a clocked time by the clocking means indicates a predetermined timer set time.

Moreover, the remote control unit further comprises: forced mode setting means for setting the time setting mode without depending on the mode switching means, when the battery is attached.

According to the present invention, the time setting mode is forcibly set by the forced mode setting means at a time when the battery is attached in order to start use of the remote control unit, and a time when the battery runs out and is changed. Therefore, the user can immediately operate the time setting means to set the clocking initial value of the clocking means easily without performing an operation to switch the mode to the time setting mode by the mode switching means.

Additionally, the forced mode setting means switches the mode from the time setting mode to the operation instructing mode without depending on the mode switching means, when an operation of setting the clocking initial value by the time setting means is not performed by the user within a predetermined time from the time when the battery is attached.

According to the present invention, if the operation of setting the clocking initial value by the time setting means is not performed within the predetermined time from the time when the battery is attached, the time setting mode is switched to the operation instructing mode by the forced mode setting means. Therefore, in a case where the user does not desire that the control signal to instruct the operation start or stop is transmitted by the operation control means at the timer set time, and the clocking by the clocking means is not required, it is possible to instruct the operation start and stop of the apparatus main body by the operation instructing means by an elapse of the predetermined time. In this case, since the user can immediately instruct the operation of the apparatus main body without operating the mode switching means to switch the mode from the time setting mode to the operation instructing mode, the unit is easy to use.

Additionally, the remote control unit further comprises: timer setting means for instructing setting of the timer operation according to operation by user in the operation instructing mode, and the forced mode setting means switches the mode from the operation instructing mode to the time setting mode, when the timer setting means is operated in the operation instructing mode in a state in which the operation of setting the clocking initial value is not performed.

In order to perform the timer operation in the present invention, it is presumed that the operation of setting the clocking initial value is performed to execute the clocking by the clocking means. Therefore, when the time setting means is operated in a state in which the clocking initial value is not set, the forced mode setting means switches the mode from the operation instructing mode to the time setting mode, and immediately brings the unit into a state in which the setting of the clocking initial value is possible. This can improve ease of use for the user, and urge the user to perform the operation of setting the clocking initial value.

DESCRIPTION OF THE PREFERRED EMBODIMENT

Figure 1:
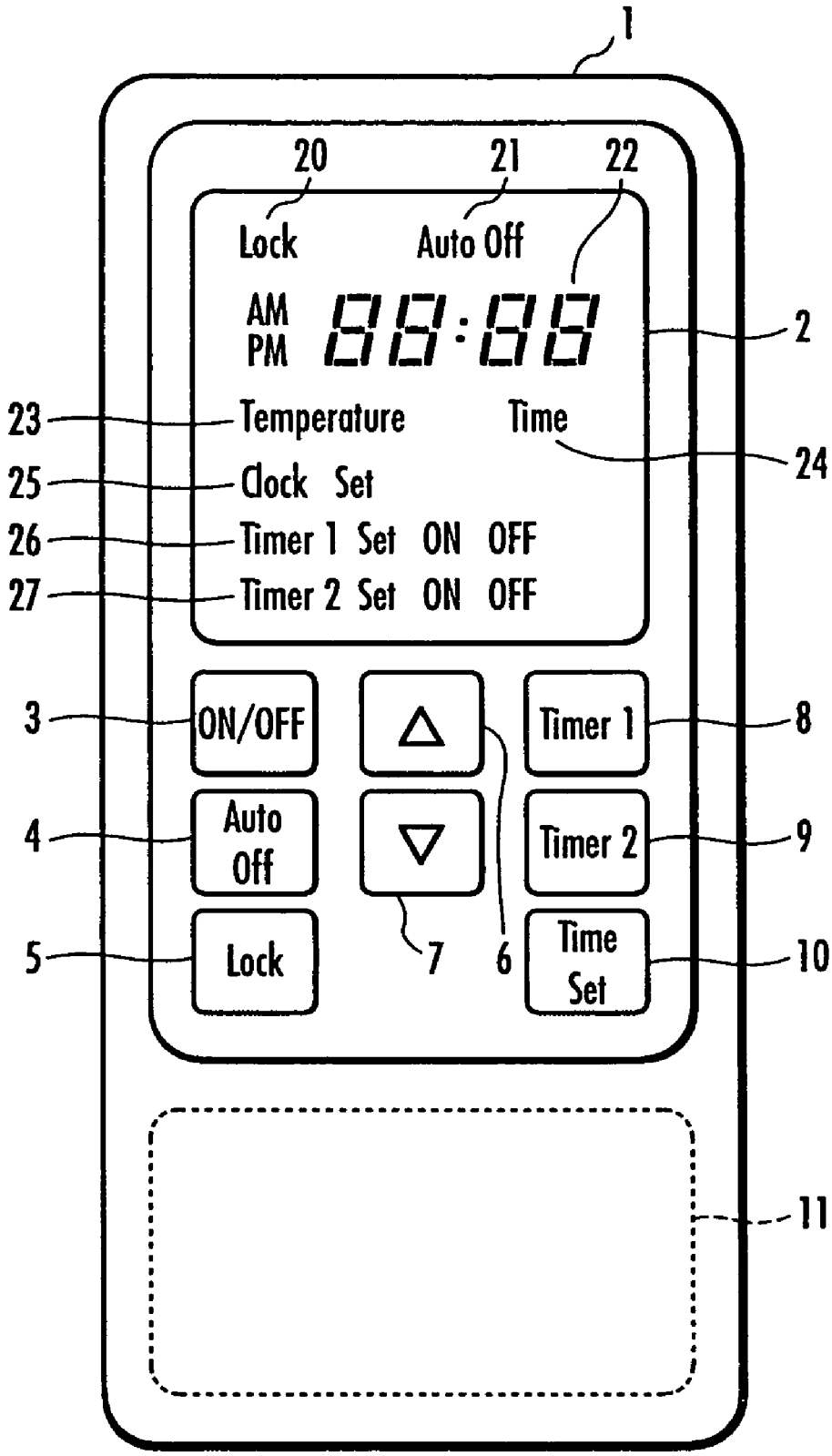
FIG. 1 is an appearance drawing of a remote control unit of the present invention.

An embodiment of the present invention will be described with reference to FIGS. 1 to 6. FIG. 1 is an appearance drawing of a remote control unit of the present invention, FIG.

Figure 2:
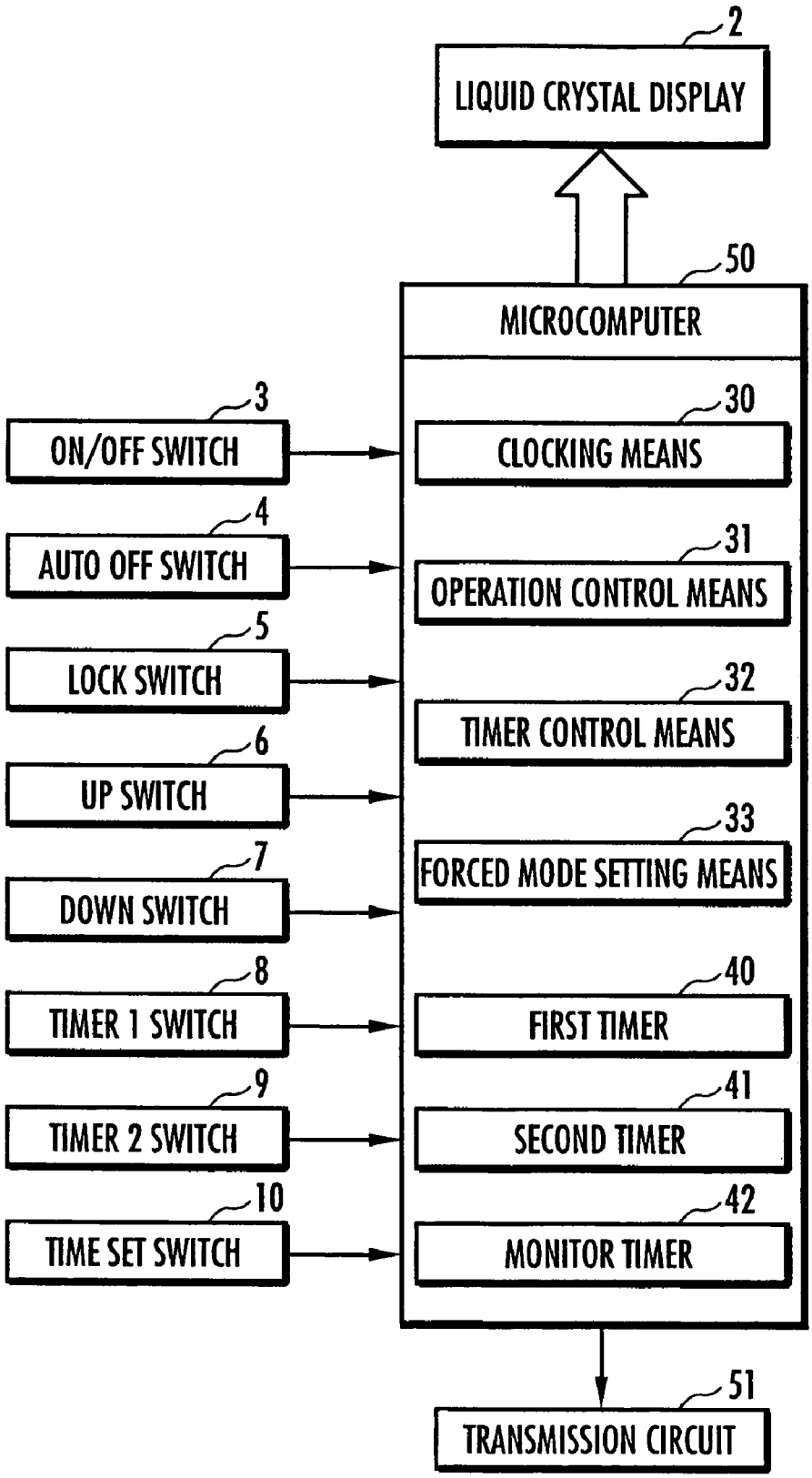
FIG. 2 is a constitution diagram of the remote control unit shown in FIG. 1.

2 is a constitution diagram of the remote control unit shown in FIG. 1, and FIGS. 3 to 6 are flowcharts showing an operation procedure of the remote control unit shown in FIGS. 1 and 2.

Referring to FIG. 1, a remote control unit 1 for remotely controlling an operation of a gas heater (corresponding to an apparatus main body of the present invention) (not shown) is provided, and is operated using a battery attached to a battery box 11 as a power supply.

The remote control unit 1 includes a liquid crystal display 2 in which various types of displays are performed, an ON/OFF switch 3 (corresponding to an operation instructing means of the present invention) which instructs actuation and de-actuation of the gas heater. The remote control unit 1 further includes an auto off switch 4 which instructs setting/canceling of an "Auto Off mode" to extinguish a gas burner at a time when room temperature exceeds a target heating temperature even where a fuel amount of the gas burner is minimized, and to re-ignite the gas burner at a time when room temperature drops below the target heating temperature by a predetermined level in a heating operation of the gas heater. The remote control unit 1 still further includes a lock switch 5 which instructs setting and canceling of a "child lock" state in which the operation of each switch is impossible, an up switch 6 (including a function of time setting means of the present invention) which instructs an increase of a set value, and a down switch 7 (including a function of the time setting means of the present invention) which instructs a decrease of the set value.

Furthermore, the remote control unit 1 includes a timer 1 switch 8 (corresponding to the timer setting means of the present invention) and a timer 2 switch 9 (corresponding to the timer setting means of the present invention) for setting a timer operation, and a time set switch 10 (including a function of mode switching means of the present invention) for switching a "time setting mode" in which the setting of an initial value of a clocking time by the up switch 6 and the down switch 7 is possible and the operation of the ON/OFF switch 3 is impossible and an "operation instructing mode" in which the setting of the initial value of the clocking time by the up switch 6 and the down switch 7 is impossible and the operation of the ON/OFF switch 3 is possible and for determining the initial value of the clocking time described later and an ON time/OFF time in the timer operation.

The liquid crystal display 2 includes a lock display portion 20 which turns on/off in response to the setting/canceling of the "child lock," an auto off display portion 21 which turns on/off in response to the setting/canceling of the "Auto Off mode," a data display portion 22 which switches and displays the target heating temperature and the clocking time, a temperature display portion 23 which turns on at a time when the target heating temperature is displayed in the data display portion 22, a time display portion 24 which turns on at a time when the clocking time is displayed in the data display portion 22, a time setting display portion 25 which turns on during setting of the clocking time, a first timer display portion 26 which displays a set state of a first timer 40 described later, and a second timer display portion 27 which displays the set state of a second timer 41 described later.

Next, referring to FIG. 2, the operation of the remote control unit 1 is controlled by a microcomputer 50 and operation signals of the switches 3 to 10 are input into the microcomputer 50. Display contents of the liquid crystal display 2 are changed in response to a display control signal output from the microcomputer 50, and an operation control signal output from the microcomputer 50 is radio-transmitted to the gas heater via a transmission circuit 51.

The microcomputer 50 includes a clocking means 30 for performing clocking processing, an operation control means 31 for instructing the operation start and stop with respect to the gas heater, a timer control means 32 for setting the timer operation, a forced mode setting means 33 for setting the "time setting mode" and the "operation instructing mode" without depending on the operation of the time set switch 10, the first and second timers 40 and 41 for use in the timer operation, and a monitor timer 42 for use in switching from the "time setting mode" to the "operation instructing mode" by the forced mode setting means 33 or the like.

Next, an operation of the remote control unit 1 will be described with reference to flowcharts of FIGS. 3 to 6. The remote control unit 1 starts its operation when the battery is inserted into the battery box 11 (a use starting time of the remote control unit 1, or a battery changing time). Moreover, the forced mode setting means 33 disposed in the microcomputer 50 sets the "time setting mode" in which the setting of the clocking initial value of the clocking means 30 is possible by the operation of the up switch 6 and the down switch 7. In the "time setting mode", the microcomputer 50 displays the clocking initial value (initial data is AM12:00) in the data display portion 22 and turns on the time setting display portion 25 in step 1. The microcomputer starts the monitor timer 42 in step 2.

When the battery is attached to the battery box 11 to start the operation of the remote control unit 1 in this manner, the mode is set to the "time setting mode" by the forced mode setting means 33. Therefore, the user can immediately operate the up switch 6 and the down switch 7 to set the clocking initial value without operating the time set switch 10.

Figure 3:
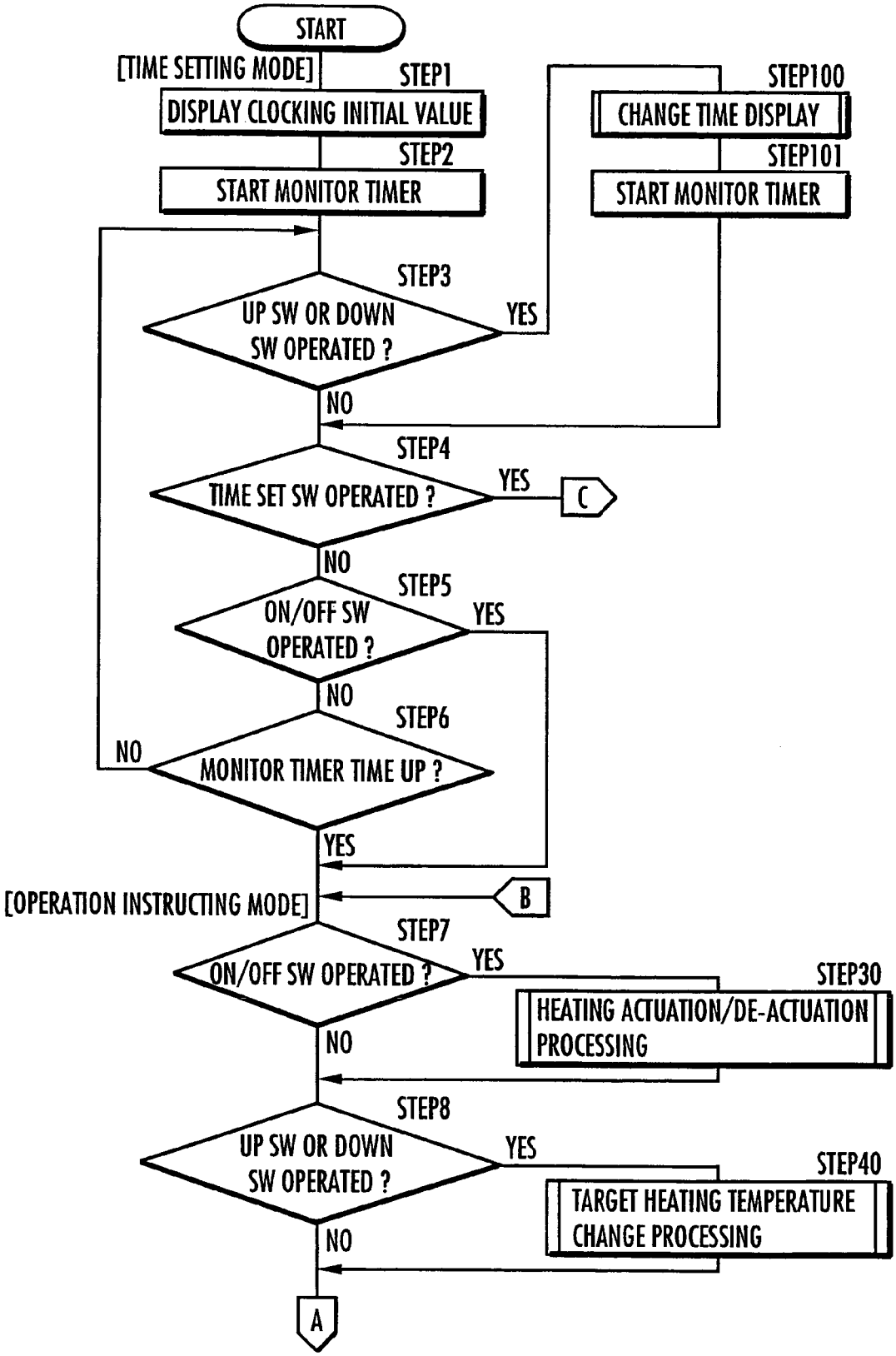
FIG. 3 is a flowchart showing an operation procedure of the remote control unit shown in FIGS. 1 and 2.

Referring to steps 3 to 6 in FIG. 3, in step 3 the forced mode setting means 33 confirms the presence/absence of the operation of the up switch 6 or the down switch 7, in step 4 the forced mode setting means 33 confirms the presence/absence of the operation of the time set switch 10, in step 5 the forced mode setting means 33 confirms the presence/absence of the operation of the ON/OFF switch 3, and in step 6 the force mode setting means 33 confirms whether or not time is up in the monitor timer 42 in step 6. Moreover, when the up switch 6 or the down switch 7 is operated in step 3, the processing is branched to step 100.

In step 100, the microcomputer 50 advances a displayed time of the data display portion 22 in response to the operation of the up switch 6, and delays the displayed time of the data display portion 22 in response to the operation of the down switch 7. In step 101, the monitor timer 42 is started (restarted), and the processing advances to step 4. When the time set switch 10 is operated in step 4, the processing is branched to step 110 of FIG. 5. Moreover, in step 110, the clocking means 30 determines the time displayed in the data display portion 22 as the clocking initial value to start clocking.

Figure 5:
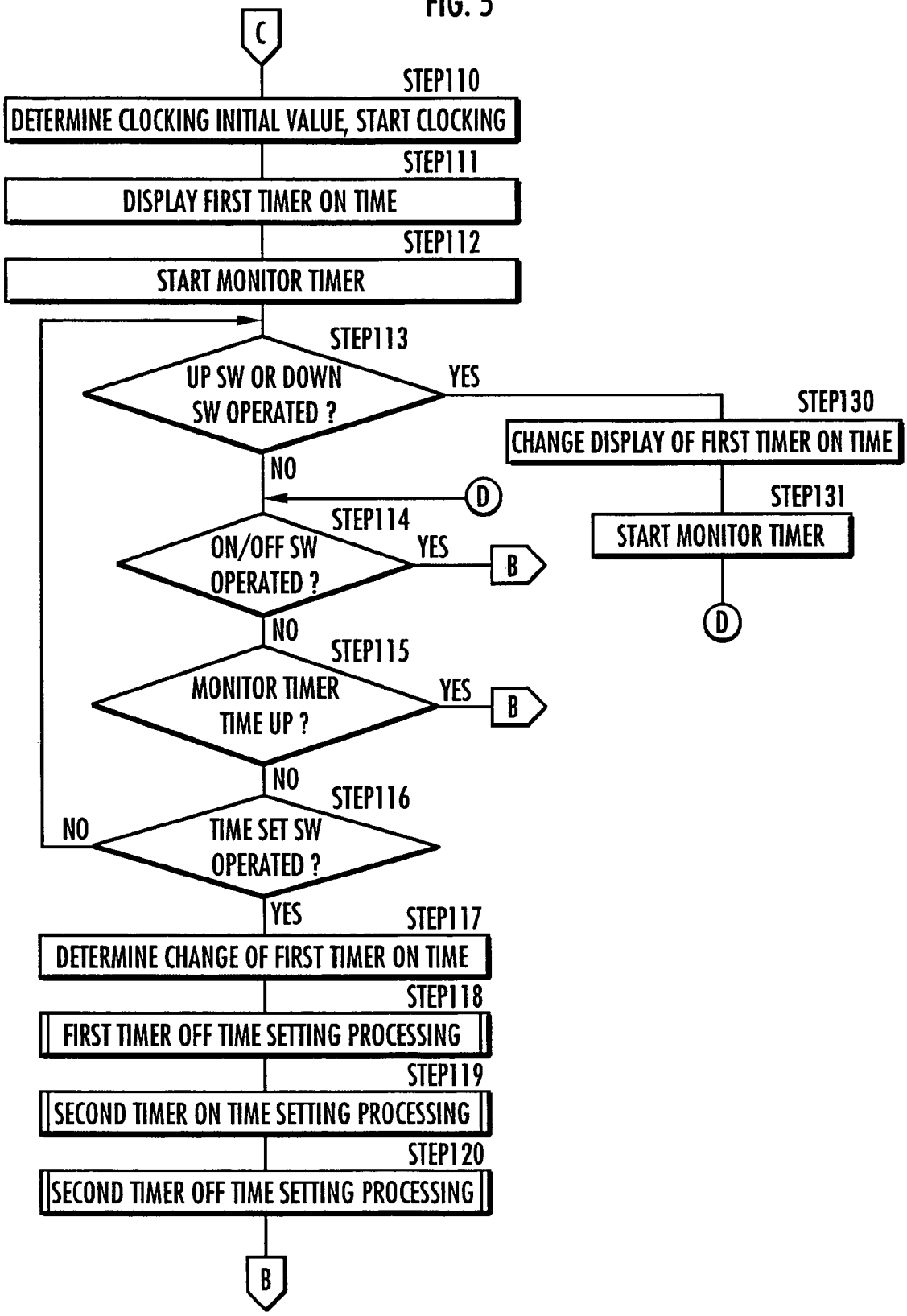
FIG. 5 is a flowchart showing an operation procedure of the remote control unit shown in FIGS. 1 and 2.

Steps 111 to 117 and 130 and 131 in FIG. 5 are processing to set a "first timer ON time" which is a time to start the operation of the gas heater in the timer operation by the first timer 40. Moreover, the microcomputer 50 turns on display "Timer1 Set ON" in the first timer display portion 26, and displays the present set value (initial value is AM6:00) of the "first timer ON time" in the data display portion 22 in step 111.

Referring to steps 113 to 116, in step 116 the microcomputer 50 confirms the presence/absence of the operation of the time set switch 10, in step 113 the microcomputer 50 confirms the presence/absence of the operation of the up switch 6 or the down switch 7, in step 114 the microcomputer 50 confirms the presence/absence of the operation of the ON/OFF switch 3, and in step 115 the microcomputer 50 confirms whether or not the time is up in the monitor timer 42.

Moreover, when the up switch 6 or the down switch 7 is operated in step 113, the processing is branched to step 130. The microcomputer 50 advances the time displayed in the data display portion 22 in response to the operation of the up switch 6, and delays the time displayed in the data display portion 22 in response to the operation of the down switch 7. Moreover, in step 131, the monitor timer 42 is started (re-started) to advance to step 114.

Furthermore, when the ON/OFF switch 3 is operated in step 114, and the time is up in the monitor timer 42 in step 115, the processing advances to step 7 of FIG. 3. In this case, the "first timer ON time" is not changed.

On the other hand, when the time set switch 10 is operated in step 116, the processing advances to step 117. Moreover, the microcomputer 50 sets the time displayed in the data display portion 22 to a new "first timer ON time", and the change of the "first timer ON time" is accordingly determined.

Then, the microcomputer 50 subsequently performs a "first timer OFF time setting processing" of step 118, a "second timer ON time setting processing" of step 119, and a "second timer OFF time setting processing" of step 120, advances to step 7 of FIG. 3, and switches the mode to the "operation instructing mode" in which the operation of the ON/OFF switch 3 is possible.

Here, since the contents of the "first timer OFF time setting processing", the "second timer ON time setting processing", and the "second timer OFF time setting processing" are similar to the above-described "first timer ON time setting processing" except that the time (first timer OFF time, second timer ON time, and second timer OFF time) which is the target to be changed differs, the description thereof is omitted.

It is to be noted that display "Timer1 Set OFF" turns on in the first timer display portion 26 in the "first timer OFF time setting processing". Display "Timer2 Set ON" turns on in the second timer display portion 27 in the "second timer ON time setting processing". Display "Timer2 Set OFF" turns on in the second timer display portion 27 in the "second timer OFF time setting processing".

Additionally, when the processing advances to step 7 of FIG. 3 to switch the mode to the "operation instructing mode", the microcomputer 50 turns on the time display portion 24, and displays the clocking time by the clocking means 30 in the data display portion 22.

Furthermore, referring to steps 3 to 6 of FIG. 3, in a case where the up switch 6 or the down switch 7 is not operated in step 3, and the ON/OFF switch 3 is operated in step 5 or the time is up in the monitor timer 42 in step 6, the forced mode setting means 33 switches the mode from the "time setting mode" to the "operation instructing mode". Moreover, the microcomputer 50 executes step 7 to step 13 of FIG. 4.

Consequently, when the user does not operate the up switch 6 or the down switch 7 before the elapse of a set time (e.g., 90 seconds, corresponding to a predetermined time of the present invention) of the monitor timer 42 from a time when the battery is attached to the battery box 11 to start the operation of the remote control unit 1, or when the user operates the ON/OFF switch 3, the "time setting mode" is switched to the "operation instructing mode".

Therefore, in a case where the timer operation is not utilized, and the clocking initial value of the clocking means 30 does not have to be set, the user can instruct the actuation and the de-actuation of the heater with the operation of the ON/OFF switch 3 by waiting for the elapse of 90 seconds from the time of the attaching of the battery, or operating the ON/OFF switch 3.

Moreover, when the ON/OFF switch 3 is operated in step 7, the processing advances to step 30, and "heating actuation/de-actuation processing operation" is executed by the operation control means 31. In a case where the gas heater is in a stopped state in the "heating actuation/de-actuation processing operation", when the ON/OFF switch 3 is operated, the operation control means 31 radio-transmits a signal to instruct the actuation to the gas heater via the transmission circuit 51.

On the other hand, when the ON/OFF switch 3 is operated where the gas heater is in an operating state, the operation control means 31 radio-transmits a signal to instruct the de-actuation to the gas heater via the transmission circuit 51. It is to be noted that during the operation of the gas heater, the microcomputer 50 turns on the temperature display portion 23 of the liquid crystal display 2, and displays the target heating temperature in the data display portion 22.

Moreover, when the up switch 6 or the down switch 7 is operated in step 8, the processing is branched to step 40 to execute "target heating temperature change processing". In the "target heating temperature change processing", the microcomputer 50 changes the setting of the target heating temperature in response to operation contents of the up switch 6 and the down switch 7, and transmits data of the changed target heating temperature to the heater via the transmission circuit 51. At this time, the changed target heating temperature is displayed in the data display portion 22.

Figure 4:
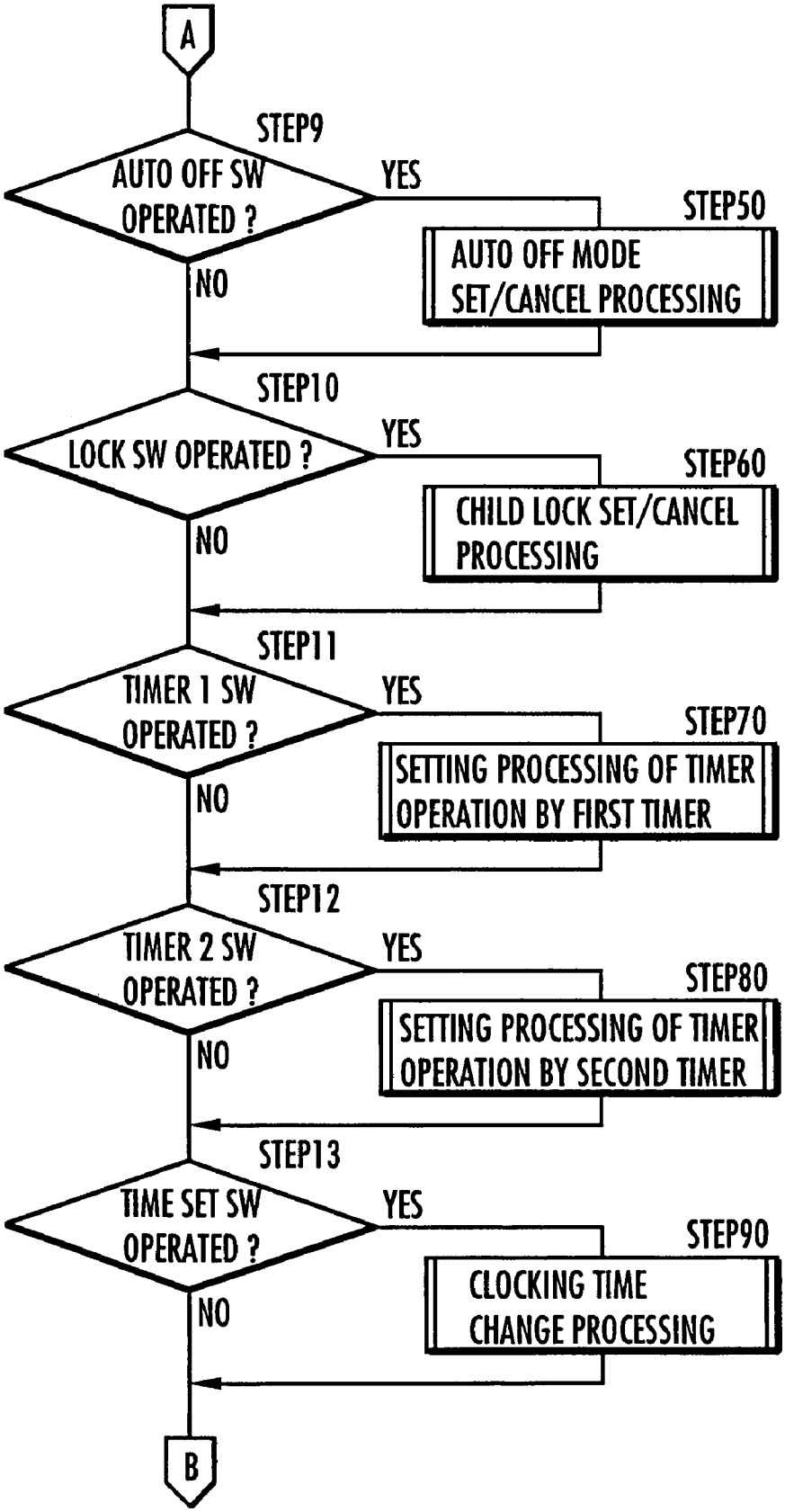
FIG. 4 is a flowchart showing an operation procedure of the remote control unit shown in FIGS. 1 and 2.

Furthermore, when the auto off switch 4 is operated in step 9 of FIG. 4, the processing is branched to step 50, and an "Auto Off mode set/cancel processing" is executed by the operation control means 31. When the auto off switch 4 is operated in a state in which the above-described "Auto Off mode" is not set, the operation control means 31 radio-transmits a control signal to instruct the setting of Auto Off to the heater via the transmission circuit 51.

On the other hand, when the auto off switch 4 is operated in a state in which the "Auto Off mode" is already set, the operation control means 31 radio-transmits a control signal to instruct the canceling of Auto Off to the heater via the transmission circuit 51. Moreover, the auto off display portion 21 turns on/off in response to the setting/canceling of the "Auto Off mode".

Additionally, when the lock switch 5 is operated in step 10 of FIG. 4, the processing is branched to step 60, and "child lock set/cancel processing" is executed. The "child lock" is used to prohibit the remote control unit 1 from being operated by an infant. When the lock switch 5 is pressed, the microcomputer 50 sets the "child lock". Moreover, when the lock switch 5 is pressed for a longer duration in a state in which the "child lock" is set, the microcomputer 50 cancels the "child lock". In this case, the lock display portion 20 of the liquid crystal display 2 is turned on/off in response to the setting/canceling of the "child lock".

Moreover, when the timer 1 switch 8 is operated in step 11 of FIG. 4, the processing is branched to step 70, and "setting processing of the timer operation by the first timer" is executed by the timer control means 32. In the "setting processing of the timer operation by the first timer", such timer operation is set so as to actuate the gas heater at the "first timer ON time" and to de-actuate the gas heater at the "first timer OFF time".

In this case, the microcomputer 50 turns on display "Timer1" in the first timer display portion 26 of the liquid crystal display 2, and informs that the timer operation by the first timer 40 is set. It is to be noted that when the ON/OFF switch 3 is operated in a state in which the timer operation by the first timer 40 is set, the setting of the timer operation is cancelled.

Figure 6:
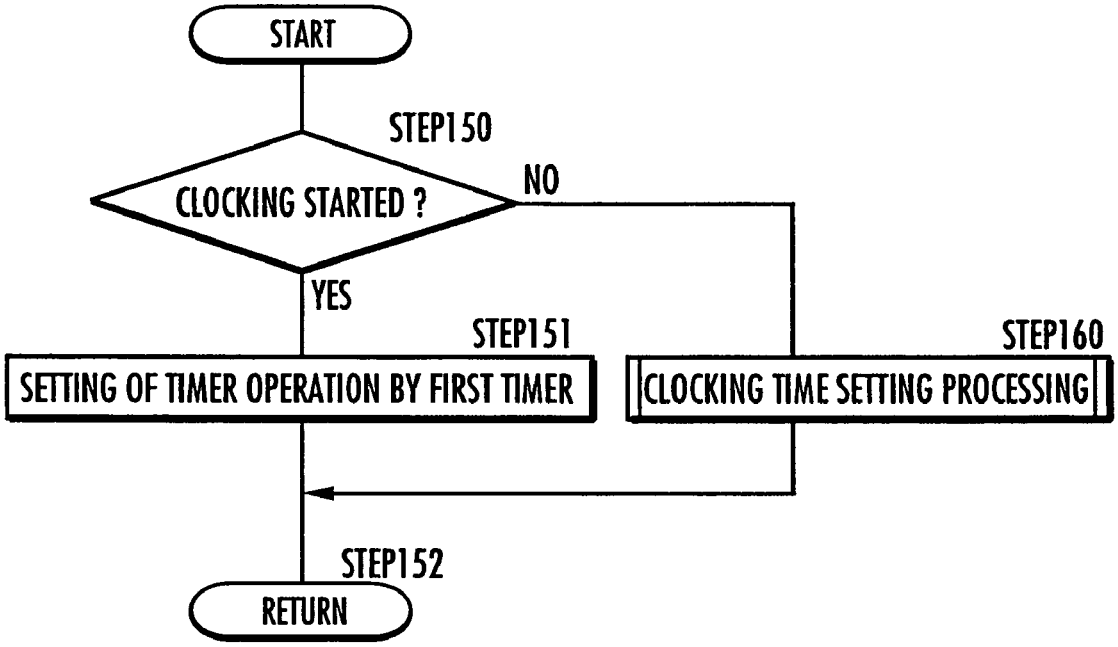
FIG. 6 is a flowchart showing an operation procedure of the remote control unit shown in FIGS. 1 and 2.

FIG. 6 is a flowchart showing processing contents of the "setting processing of the timer operation by the first timer". The microcomputer 50 first judges in step 150 whether or not clocking by the clocking means 30 is already started. When the clocking is started, the processing advances to step 151 to set the timer operation by the first timer, and advances to step 152 to end the processing.

On the other hand, when the clocking by the clocking means 30 is not started in step 150, the processing is branched to step 160, and the "operation instructing mode" is switched to the "time setting mode" by the forced mode setting means 33. Moreover, the microcomputer 50 executes "clocking time setting processing" to set and change the "clocking initial value", the "first timer ON time", the "first timer OFF time", the "second timer ON time", and the "second timer OFF time" in the same manner as in the processing shown in steps 2 to 6 and 100 and 101 of FIG. 3, and FIG. 5 as described above.

Moreover, when the timer 2 switch 9 is operated in step 12 of FIG. 4, the processing is branched to step 80, and "setting processing of the timer operation by the second timer" is executed by the timer control means 32. The processing contents of the "setting processing of the timer operation by the second timer" are similar to those of the above-described "setting processing of the timer operation by the first timer". The timer operation is set in such a manner so as to actuate the gas heater at the "second timer ON time" and to de-actuate the gas heater at the "second timer OFF time". In this case, the microcomputer 50 turns on display "Timer2" in the second timer display portion 27 of the liquid crystal display 2, and informs that the timer operation by the second timer 41 is set. It is to be noted that when the ON/OFF switch 3 is operated in a state in which the timer operation by the second timer 41 is set, the setting of the timer operation is canceled.

Furthermore, when the time set switch 10 is operated in step 13 of FIG. 4, the processing advances to step 90, the mode is switched to the "time setting mode", and "clocking time change processing" is executed. In the "clocking time change processing", change processing of the "clocking initial value", the "first timer ON time", the "first timer OFF time", the "second timer ON time", and the "second timer OFF time" is executed in the same manner as in the processing of steps 2 to 6 and 100 and 101 of FIG. 3, and FIG. 5 described above.

It is to be noted that in a case where the clocking by the clocking means 30 is already performed, even when an operation of changing the time display is performed with respect to the data display portion 22 by the up switch 6 or the down switch 7 (corresponding to the processing of steps 3 and 100 of FIG. 3), the clocking of the clocking means 30 is continued irrespective of the time display of the data display portion 22.

Moreover, in a case where the time set switch 10 (corresponding to step 4 of FIG. 3) is not operated, and the ON/OFF switch 3 (corresponding to step 5 of FIG. 3) is operated or the time is up in the monitor timer 42 (corresponding to step 6 of FIG. 3), and the mode is switched to the "operation instructing mode", the change of the clocking time of the clocking means 30 is not determined. Therefore, the clocking time of the clocking means 30 is not changed, and the time displayed in the data display portion 22 which has been changed in response to the operation of the up switch 6, the down switch 7 is switched to the clocking time of the clocking means 30 which has continued the clocking even during the change processing of the clocking time.

It is to be noted that in the present embodiment, the remote control unit has been described which remote-controls the gas heater as the apparatus main body of the present invention, but the present invention can be applied to any remote control unit as long as the unit is operated by the battery to remote-control the setting of the timer operation with respect to the apparatus main body.

Moreover, in the present embodiment, when the up switch 6 or the down switch 7 is not operated within the predetermined time from the time of the attaching of the battery in the loop of steps 3 to 6 of FIG. 3, the forced mode setting means 33 advances from step 6 to step 7 to perform the processing to switch the mode from the "time setting mode" to the "operation instructing mode", but an effect of the present invention can be obtained even in a case where such processing is not performed.

What is claimed is:

1. A remote control unit which is operated by a battery to remote-control operation start and operation stop of an apparatus main body, comprising:

communication means for communicating with the apparatus main body;

operation instructing means for instructing the operation start and the operation stop of the apparatus main body according to operation by user;

clocking means;

time setting means for setting a clocking initial value of the clocking means according to operation by the user;

mode switching means for switching according to operation by the user an operation instructing mode in which the instruction by the operation instructing means is possible and the setting of the clocking initial value by the time setting means is impossible and a time setting mode in which the operation instruction by the operation instructing means is impossible and the setting of the clocking initial value by the time setting means is possible;

operation control means for transmitting a control signal to instruct actuation or de-actuation with respect to the apparatus main body, when the operation instructing means is operated; and timer control means for setting timer operation to perform the actuation or the de-actuation of the apparatus main body, when a clocked time by the clocking means indicates a predetermined timer set time, wherein the remote control unit further comprises forced mode setting means for automatically setting the time setting mode without depending on the mode switching means, when the battery is installed.

2. The remote control unit according to claim 1, wherein the forced mode setting means switches the mode from the time setting mode to the operation instructing mode without depending on the mode switching means, when an operation of setting the clocking initial value by the time setting means is not performed by the user within a predetermined time from a time when the battery is installed.

3. The remote control unit according to claim 1, further comprising:

timer setting means for instructing setting of the timer operation according to operation by user in the operation instructing mode, wherein the forced mode setting means switches the mode from the operation instructing mode to the time setting mode, when the timer setting means is operated in the operation instructing mode in a state in which the operation of setting the clocking initial value is not performed.

4. The remote control unit according to claim 2, further comprising:

timer setting means for instructing setting of the timer operation according to operation by user in the operation instructing mode, wherein the forced mode setting means switches the mode from the operation instructing mode to the time setting mode, when the timer setting means is operated in the operation instructing mode in a state in which the operation of setting the clocking initial value is not performed.

* * * * *